US009663912B2

(12) United States Patent
Abe et al.

(10) Patent No.: US 9,663,912 B2
(45) Date of Patent: May 30, 2017

(54) LITTER SEPARATING APPARATUS

(71) Applicant: HONDA MOTOR CO., LTD., Minato-Ku, Tokyo (JP)

(72) Inventors: Kamio Abe, Wako (JP); Yoshihiro Kimura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 273 days.

(21) Appl. No.: 14/278,199

(22) Filed: May 15, 2014

(65) Prior Publication Data

US 2014/0345887 A1 Nov. 27, 2014

(30) Foreign Application Priority Data

May 24, 2013 (JP) ..... 2013-110410

(51) Int. Cl.
*E01H 12/00* (2006.01)

(52) U.S. Cl.
CPC ..... *E01H 12/002* (2013.01)

(58) Field of Classification Search
CPC ..... E01H 12/002
USPC ..... 171/135, 63
See application file for complete search history.

(56) References Cited

U.S. PATENT DOCUMENTS 625,669 A * 5/1899 Gorr ..... A01D 34/42 56/200
2,706,877 A * 4/1955 Caldwell ..... A01B 43/00 171/109
2,804,156 A * 8/1957 Greaves ..... A01B 43/00 171/63
3,010,523 A * 11/1961 Gifford ..... A01B 43/00 15/78
3,139,939 A * 7/1964 Vickery ..... A01B 43/00 171/132
3,734,193 A * 5/1973 Molnau et al. ..... A01D 25/044 171/57
4,050,518 A 9/1977 Gilmour
4,993,498 A * 2/1991 Fresnel ..... E01H 12/002 111/131
7,997,349 B2 8/2011 Arai et al.

FOREIGN PATENT DOCUMENTS

JP 2007-270580 A 10/2007

* cited by examiner

*Primary Examiner* — Thomas B Will
*Assistant Examiner* — Joel F. Mitchell
(74) *Attorney, Agent, or Firm* — Carrier Blackman & Associates, P.C.; Joseph P. Carrier; Anne G. Sabourin

(57) ABSTRACT

A litter separating apparatus includes a frame, a churn-up mechanism provided at a front portion of the frame, and a mesh member provided at a rear portion of the frame. During operation, when the separating apparatus is towed on the surface of sand ground, the churn-up mechanism churns up litter along with sand, and throws thus churned up litter into said mesh member which catches the litter. The mesh member includes an encircling portion including a rear wall and side walls, and having an opening formed therein. The mesh member is attached pivotally to one of longitudinal members of the frame. An opening-closing plate is pivotally arranged around an open-side edge of one of the side walls on the longitudinal member to which the mesh member is pivotally attached. Such litter separating apparatus prevents litter from dropping out from the mesh member during collection of the litter.

14 Claims, 9 Drawing Sheets

LITTER SEPARATING APPARATUS

CROSS-REFERENCE TO RELATED APPLICATIONS

The present invention claims priority under 35 USC 119 based on Japanese Patent Application No. 2013-110410, filed on May 24, 2013. The entire subject matter of this priority document, including specification claims and drawings thereof, is incorporated by reference herein.

BACKGROUND OF THE INVENTION

1. Field of the Invention

The present invention relates to a litter separating apparatus for collecting litter in a beach. More particularly, the present invention relates to a litter separating apparatus which is capable of preventing litter from dropping out from a mesh member during collection of the litter.

2. Description of the Background Art

There is known beach cleaner which travels on sand ground by being towed by a towing vehicle, and which includes a mesh member open at the front and upper sides. The mesh member separates churned up sand and litter, and catches the litter. The mesh member is then tilted to collect the litter. An example of such beach cleaner is disclosed in the Japanese Patent Application Publication No. 2007-270580.

According to the technique described in the Japanese Patent Application Publication No. 2007-270580, for collection of litter, the right side of the mesh member is pivoted upward around the left side of the mesh member to discharge the litter inside the mesh member. In this technique, the litter may possibly drop out of the mesh member from the front side.

The present invention has been made to overcome the drawbacks of existing litter separating apparatus. Accordingly, it is one of the objects of the present invention is to provide a litter separating apparatus having a simple construction, and which is capable of preventing litter from dropping out during collection of the litter.

SUMMARY OF THE INVENTION

In order to achieve the above objects, the present invention according to a first aspect thereof provides a litter separating apparatus (10), including: a frame (74) having a plurality of longitudinal members (70) each extending in a traveling direction of the litter separating apparatus, and a plurality of transverse members (72*a*, 72*b*) each extending in a transverse direction perpendicularly to the longitudinal members (70); and a tow portion (98) provided at a front end portion of the frame (74), a churn-up mechanism (76, 78) provided at a front portion of the frame (74), and a mesh member (80) provided at a rear portion of the frame (74); wherein: during operation, when the litter separating apparatus (10) travels on a surface of sand ground by being towed by a towing vehicle (14), the churn-up mechanism churns up scattered litter along with sand, and throws thus churned up litter into the mesh member which catches the litter; the mesh member (80) includes an encircling portion (156) including a rear wall (152) and side walls (154), the encircling portion (156) having an opening (80*a*) formed therein, said opening being operable to open at least at a side facing the traveling direction, the mesh member (80) is mounted on the longitudinal members (70) of the frame (74) on opposite sides, and the mesh member (80) is attached upwardly pivotally to one of the longitudinal members (70) of the frame (74) located on the opposite sides, an opening-closing plate (160) is provided to an open-side edge (154*a*) of the side wall (154) on the longitudinal member (70) to which the mesh member (80) is pivotally attached, the opening-closing plate (160) being pivotable around the edge (154*a*), and the opening-closing plate (160) opens and closes the opening (80*a*) at least partially.

The present invention according to a second aspect thereof provides the above-described litter separating apparatus (10), in which the opening-closing plate (160) is attached to the encircling portion (156) by a suitable arrangement, such as a springed hinge (162).

The present invention according to a third aspect thereof provides the above-described litter separating apparatus (10), in which the opening-closing plate (160) is biased by the springed hinge (162) to close the opening (80*a*) and is fixed substantially at a right angle to the side wall (154), and the litter separating apparatus (10) further includes a stopper (170) which stops biasing force of the springed hinge (162) such that the opening-closing plate (160) faces the same direction as the side wall (154) during travel.

The present invention according to a fourth aspect thereof provides the above-described litter separating apparatus (10), in which a height of the opening-closing plate (160) is substantially the same as a height of the encircling portion (156).

Effects of the Invention

According to the first aspect of the present invention, the opening-closing plate is provided to the open-side edge of the side wall on the longitudinal member to which the mesh member is pivotally attached, the opening-closing plate is pivotable around the edge, and the opening-closing plate opens and closes the opening at least partially. Thus, by closing the opening-closing plate during collection of litter, the litter in the mesh member can be prevented from dropping out of the encircling portion from the front side. Such arrangement eliminates the need for picking up dropped litter and further improves the efficiency of collection. Accordingly, the man-hour is reduced.

According to the second aspect of the present invention, the opening-closing plate is attached to the encircling portion by the springed hinge. Accordingly, the opening-closing plate can be pivotally attached with a simple construction.

According to the third aspect of the present invention, the opening-closing plate is biased by the springed hinge to close the opening and is fixed substantially at a right angle to the side wall. Accordingly, the litter in the mesh member can be reliably prevented from dropping out of the encircling portion from the front side. Moreover, the biasing force of the springed hinge is stopped such that the opening-closing plate faces the same direction as the side wall during travel. Accordingly, sand and litter can be caught efficiently.

According to the fourth aspect of the present invention, the height of the opening-closing plate is substantially the same as the height of the encircling portion. Accordingly, the litter in the mesh member can be prevented from dropping out of the encircling portion from the front side during collection of the litter. Further, the opening-closing plate does not protrude upward from the encircling portion when the opening-closing plate is opened, and the exterior is therefore improved. Furthermore, the opening-closing plate does not block anything when in the stored position.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

An illustrative embodiment of a litter separating apparatus in a vehicle according to the present invention will now be described in detail with reference to the accompanying drawings.

Throughout this description, relative terms like "upper", "lower", "above", "below", "front", "back", and the like are used in reference to a vantage point of an operator of the vehicle, seated on the driver's seat and facing forward. It should be understood that these terms are used for purposes of illustration, and are not intended to limit the invention.

Figure 1:
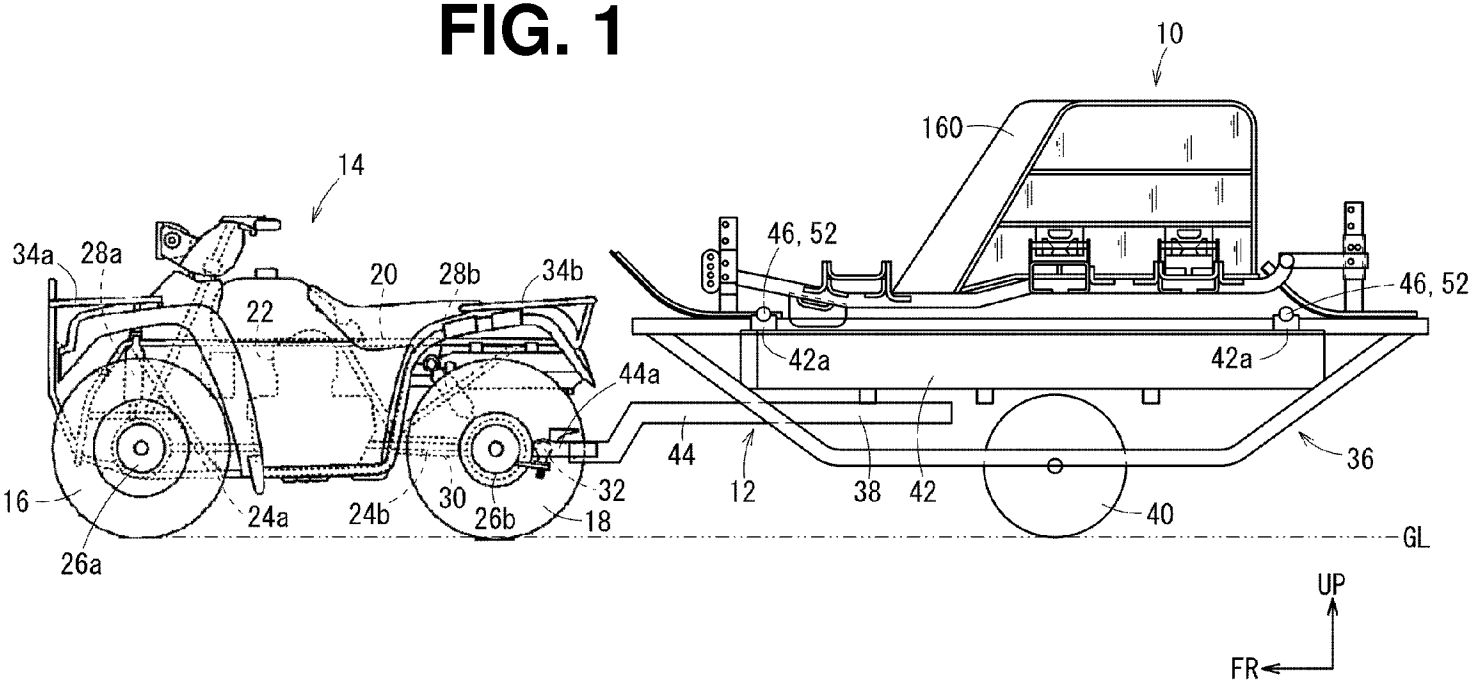
FIG. 1 is a side view showing a litter separating apparatus of an embodiment, a trailer on which the litter separating apparatus is mounted, and a towing vehicle.

FIG. 1 is a side view showing a litter separating apparatus 10 of an embodiment, a trailer 12 on which the litter separating apparatus 10 is mounted, and a towing vehicle 14. As stated above, the terms front, rear, left, right, upper, and lower are based on directions seen from the driver of the towing vehicle 14, unless otherwise noted.

In the embodiment, an All-Terrain Vehicle (ATV), which is a saddle-ride type rough-terrain vehicle, is employed as the towing vehicle 14. The towing vehicle 14 includes a pair of left and right front wheels 16 and a pair of left and right rear wheels 18, and also includes a body frame 20 and an engine 22 as a motor provided on a substantially center portion of the body frame 20.

The engine 22 outputs rotary power of from crankshaft to front and rear propeller shafts 24*a*, 24*b* via a transmission (not shown). The rotary power outputted to the front and rear propeller shafts 24*a*, 24*b* is outputted to the front and rear wheels 16, 18 via front and rear reduction gears 26*a*, 26*b*, respectively.

The front wheels 16 are each suspended on a front portion of the body frame 20 by means of a front suspension 28*a*. The rear wheels 18 are each suspended on a rear portion of the body frame 20 by means of a rear suspension 28*b* and a swing arm 30, for instance. A trailer hitch 32 for towing a trailer is disposed at a rear end portion of the swing arm 30. A front carrier 34*a* supported on the front portion of the body frame 20. A rear carrier 34*b* supported on the rear portion of the body frame 20.

The towing vehicle 14 is operable tow the trailer 12 which carries the litter separating apparatus 10 and the litter collecting station 36. The trailer 12 includes: a pair of left and right wheels 40 provided on two opposite sides of a lower portion of a body frame 38; and a carrier 42 provided on the body frame 38 and having a vertically shallow box shape open at the upper side. The body frame 38 is provided with a tow arm 44 extending frontward from the lower side of a front portion of the body frame 38. A hitch coupler 44*a* corresponding to the trailer hitch 32 is provided at a front end portion of the tow arm 44.

Supports 42*a* for supporting connecting pipes 46 of the litter collecting station 36 are provided at upper edge portions of the carrier 42 on both the front and rear sides and the left and right sides. Each of the supports 42*a* has a recess open upwardly. The litter collecting station 36 is held when the connecting pipes 46 of the litter collecting station 36 turned upside down are fitted in the recesses. The litter separating apparatus 10 is mountable on the litter collecting station 36 turned upside down.

The litter separating apparatus 10 and the litter collecting station 36 in FIG. 1 are illustrated as being mounted on the trailer 12. However, the litter separating apparatus 10 and the litter collecting station 36 shown in FIG. 2 and the following drawings are illustrated as being in use on sand ground unless otherwise noted. In some drawings, a line GL represents the ground surface (or the upper surface of sand ground), and a line CL represents the center of the towing vehicle 14, the litter separating apparatus 10 towed thereby, and the litter collecting station 36 in the left-right direction. Arrows FR, UP, and LH indicate the front, upper, and left sides, respectively.

The litter separating apparatus 10 is towed by the towing vehicle 14 to travel on sand ground, such as one at a sea coast (sandy beach), so as to pick up various kinds of litter scattered on the sand ground. The litter picked up by the litter separating apparatus 10 is collected into the litter collecting station 36 which is installed at a given place on the sand ground.

Figure 2:
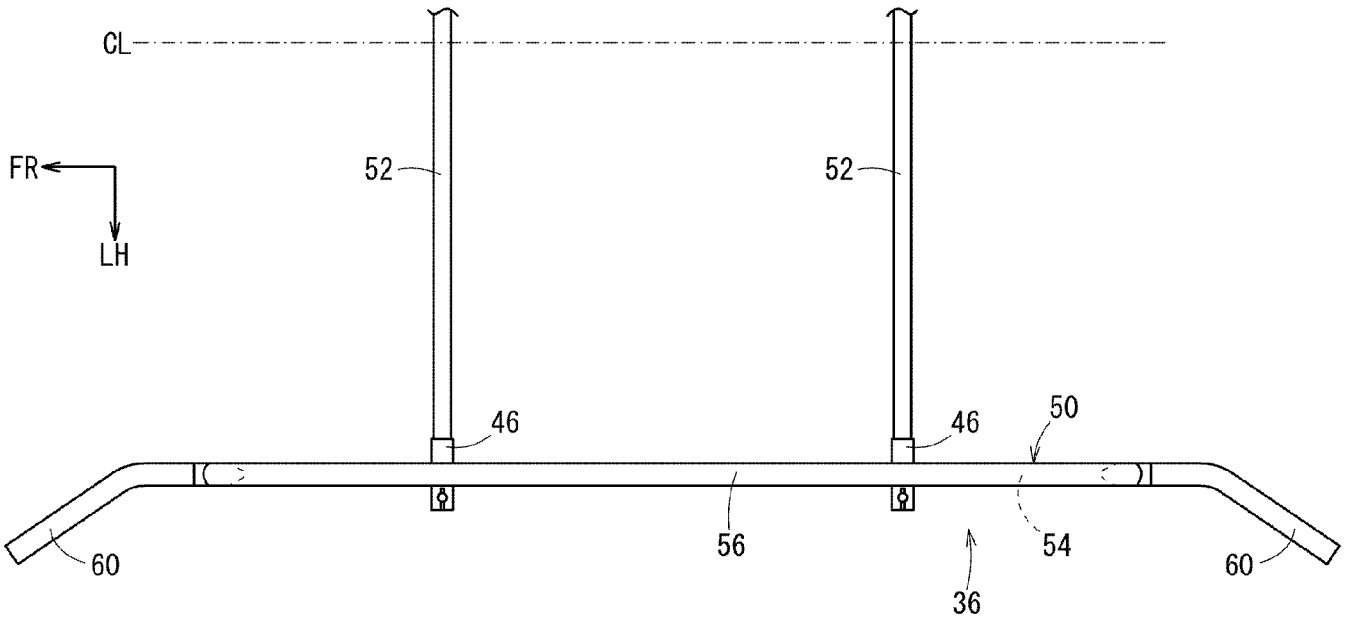
FIG. 2 is a top view of a litter collecting station shown in FIG. 1.
Figure 3:
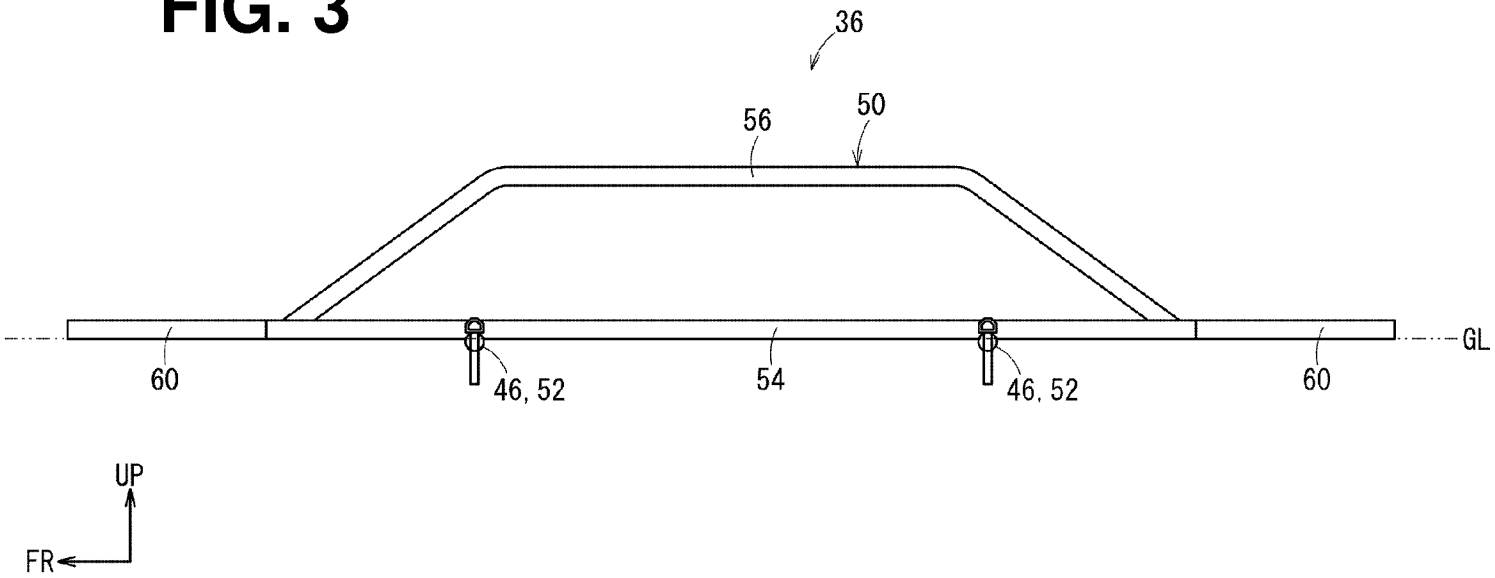
FIG. 3 is a side view of the litter collecting station shown in FIG. 1.

FIG. 2 is a top view of the litter collecting station 36, and FIG. 3 is a side view of the litter collecting station 36. Here, the construction of the litter collecting station 36 is symmetrical in the left-right direction about the line CL. Thus, the right side of the construction from the line CL is not illustrated in FIG. 2.

The litter collecting station 36 includes a pair of left and right side structures 50 extending in the traveling direction (or the front-rear direction), and connecting members 52 extending in the left-right direction and connecting the pair of left and right side structures 50 to each other at front and rear portions thereof. Each side structure 50 is such that a guide member 56, which is formed of a pipe defining a bulging shape symmetrical in the front-rear direction in side view, is connected to a pipe-shaped ground-contact member 54 extending in the front-rear direction. The ground-contact member 54 and the guide member 56 may be formed integrally with each other. The ground-contact member 54 and the connecting members 52 may be connected to each other by the connecting pipes 46. With such construction, the litter collecting station 36, which is relatively large in size, can be disassembled into a plurality of separate parts, namely, the side structures 50 and the connecting members 52.

A foot member 60 is detachably attached to each of front and rear end portions of each ground-contact member 54. In top view, each foot member 60 is inclined outward in the left-right direction toward the front or rear side (see FIG. 2). The foot member 60 contacts sand ground together with its ground-contact member 54. The foot member 60 allows the litter collecting station 36 to be installed stably.

Figure 4:
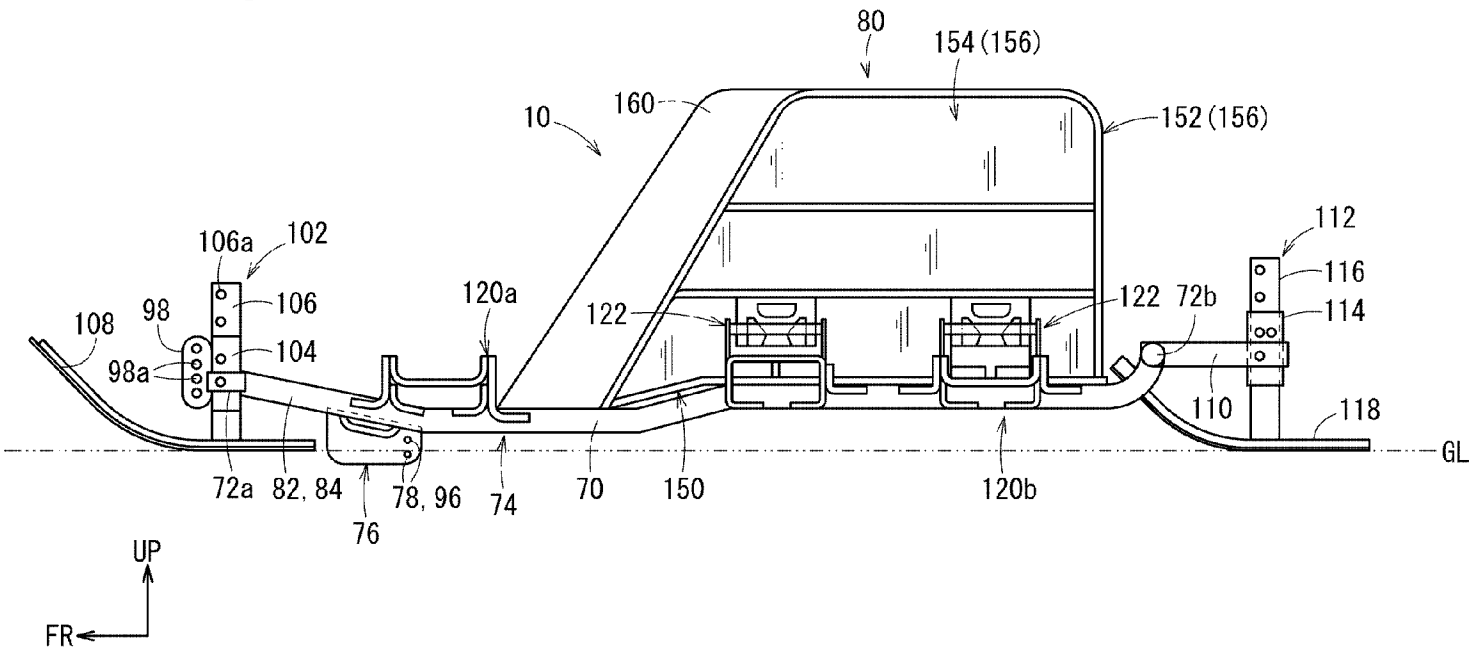
FIG. 4 is a side view of the litter separating apparatus shown in FIG. 1.
Figure 5:
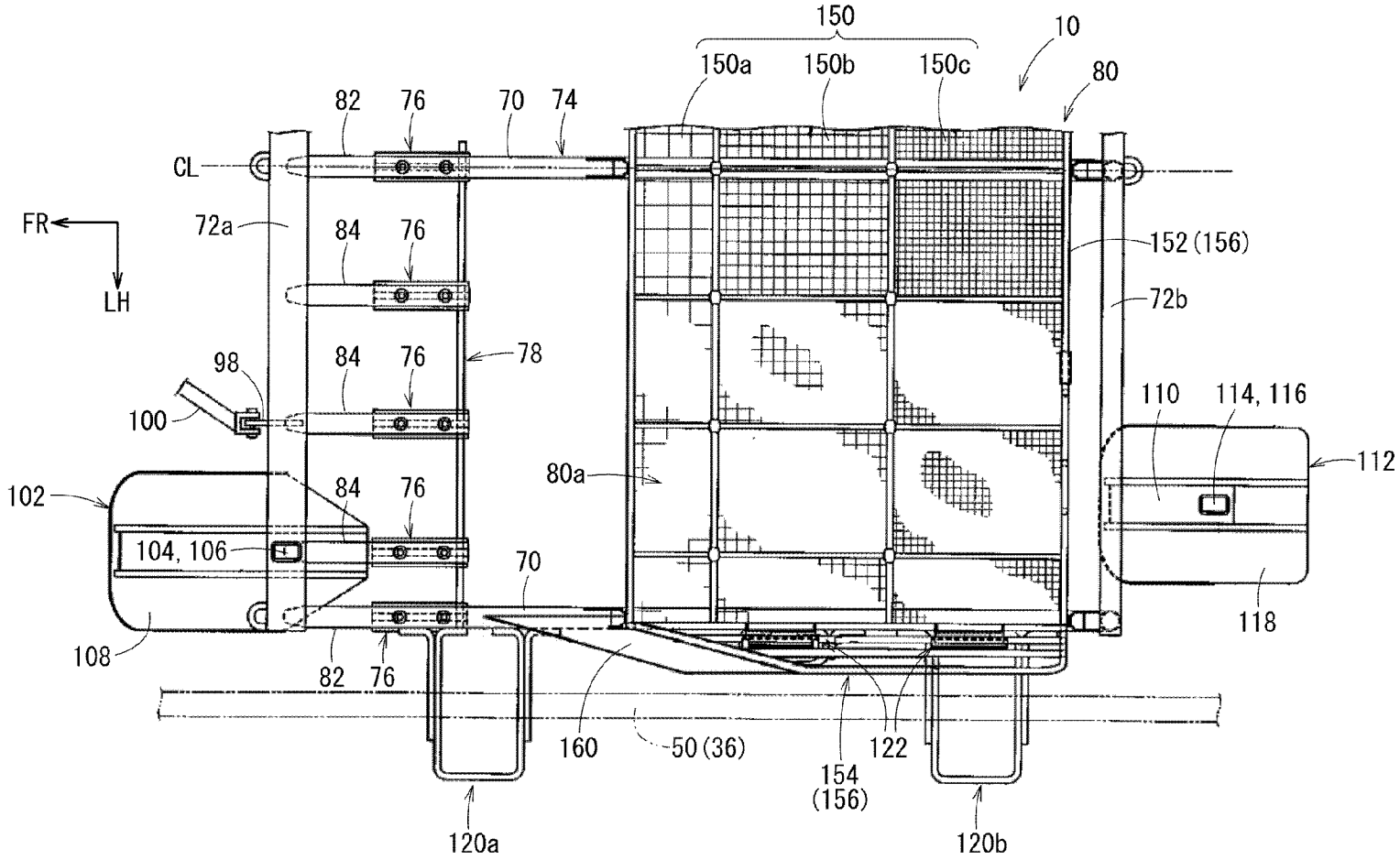
FIG. 5 is a top view of the litter separating apparatus shown in FIG. 1.

FIG. 4 is a side view of the litter separating apparatus 10, and FIG. 5 is a top view of the litter separating apparatus 10. Here, the construction of the litter separating apparatus 10 is symmetrical in the left-right direction about the line CL. Thus, the right side of the construction from the line CL is not illustrated in FIG. 5.

The litter separating apparatus 10 is such that a frame 74 in the shape of a picture frame is mainly formed of: a plurality of (three in the embodiment) pipe-shaped longitudinal members 70 each extending in the traveling direction; and pipe-shaped transverse members 72*a*, 72*b* each extending in the transverse direction (left-right direction) perpendicularly to the longitudinal members 70. A plurality of keels 76 and scrapers 78 are provided on a front portion of the frame 74, and a mesh member 80 is provided on a rear portion of the frame 74. The mesh member 80 is mounted on the longitudinal members 70 of the frame 74 on the opposite sides.

Each longitudinal member 70 is formed to be bent in a gentle crank shape, when viewed in side view, at its middle portion in the front-rear direction such that a rear portion is located slightly above a front portion. Moreover, a rear end portion of the longitudinal member 70 is curved upward. The longitudinal member 70 has at its front end an inclined portion 82 inclined in such a way as to extend upward and frontward.

A plurality of the longitudinal members 70 each having the inclined portion 82 at its front end are arranged side by side in the left-right direction in such a way as to overlap one another in side view. The front end of the inclined portion 82 is pressed against the transverse member 72*a* from the rear side to be joined thereto. The rear end of the longitudinal member 70 is pressed against the transverse member 72*b* from the lower side to be joined thereto.

A plurality of (three in the embodiment) scraper frames 84 located side by side in the left-right direction is arranged between the inclined portion 82 at the center in the left-right direction and each of the inclined portions 82 on the opposite sides in the left-right direction. The scraper frames 84 are inclined in such a way as to overlap the inclined portions 82 in side view.

Each scraper frame 84 is formed of a pipe having substantially similar diameter as the longitudinal members 70, and the front end thereof is pressed against the transverse member 72*a* from the rear side to be joined thereto. The scraper frames 84 and the longitudinal member 70 at the center in the left-right direction are arranged at almost regular intervals. However, each of the scraper frames 84 at the outermost positions in the left-right direction and the corresponding one of the longitudinal members 70 on the opposite sides in the left-right direction are arranged at a shorter interval.

The keels 76 and the scrapers 78 are attached to the inclined portions 82 and the scraper frames 84 as a churn-up mechanism which churns up sand and relatively small-sized litter (e.g., beverage containers, waste paper, and cigarette butts) while the litter separating apparatus 10 is traveling by being towed.

A plurality of scraper support holes 96 are formed in a rear end portion of each keel 76, and the scrapers 78 are inserted in and supported on the scraper support holes 96. For instance, the scrapers 78 are each a bar-shaped member extending in the left-right direction and being circular in cross section, and are respectively inserted through and supported on the scraper support holes 96 in each keel 76 arranged along the vertical direction. There may be only one or three or more scrapers 78, and the scrapers 78 may not be arranged along the vertical direction but along the left-right direction or obliquely.

The keels 76 and the scrapers 78 are placed in such a way as to be sunk in the sand by a suitable amount. In such a state, when the litter separating apparatus 10 travels, the keels 76 push through the sand and litter, and the scrapers 78 churn up the sand and litter. The sand and litter thus churned up are thrown into the mesh member 80 on the rear portion of the frame 74.

A tow portion 98 for use in towing the litter separating apparatus 10 with the towing vehicle 14 is provided on the front side of each of the second scraper frames 84 from the outer ends of the frame 74 in the left-right direction (see FIG. 5). The tow portion 98 is formed of a plate-shaped member extending perpendicular to the left-right direction, and a plurality of (four in the embodiment) connecting holes 98*a* arranged along the vertical direction are formed therein (see FIG. 4).

Figure 9:
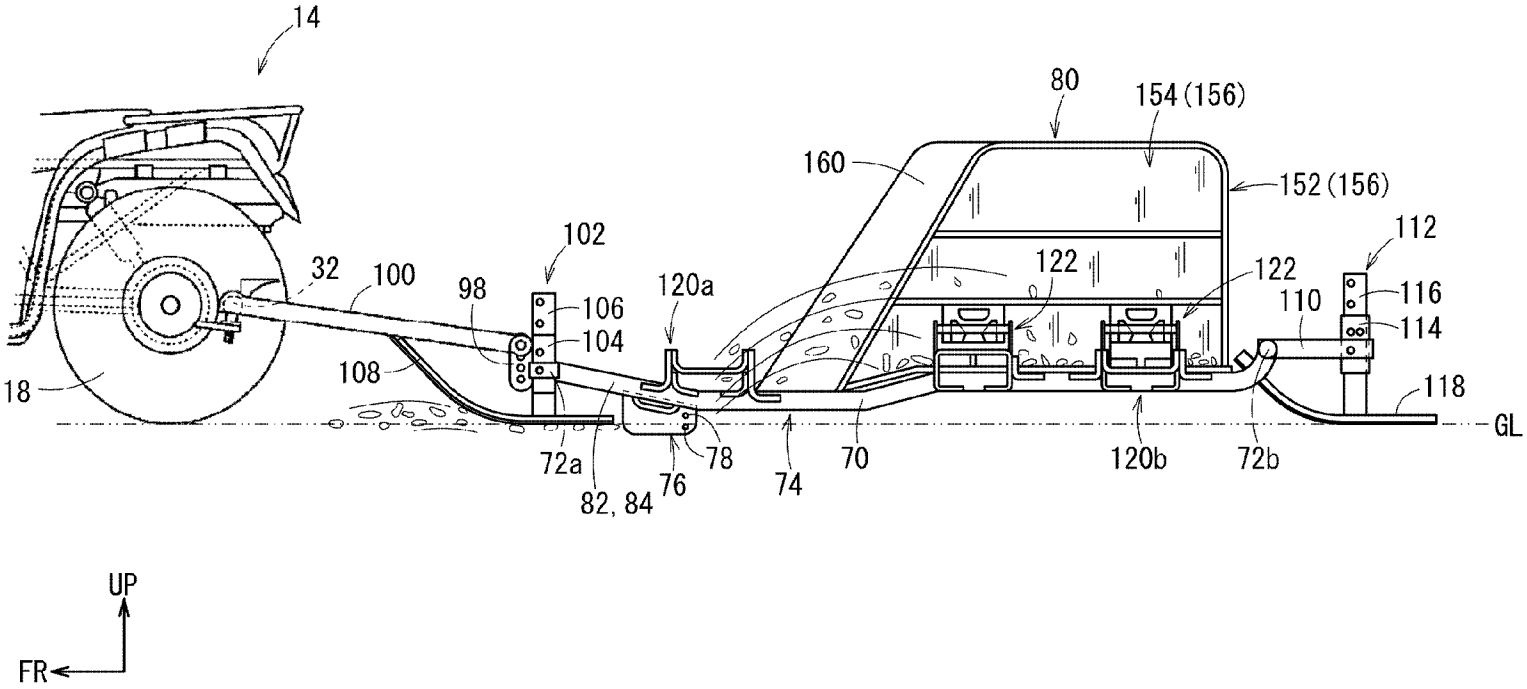
FIG. 9 is a side view showing a state where the litter separating apparatus is traveling by being towed.

During operation, a tow rod 100 is connected at one end to the trailer hitch 32 of the towing vehicle 14 and also connected at the other end to one of the connecting holes 98*a*, and the litter separating apparatus 10 is towed through the tow rod 100 (see FIG. 9). Here, by the selection of a certain one of the connecting holes 98*a* to which to connect the other end of the tow rod 100, the tow position can be set at the most suitable one that corresponds to the ground clearance of the litter separating apparatus 10 (the height from the ground surface) and other conditions.

A front ski support pipe 104 for supporting a front ski leg 102 is provided on the front side of each of the outermost scraper frames 84 of the frame 74 in the left-right direction. The front ski support pipe 104 is provided in such a way as to penetrate the transverse member 72*a* in the vertical direction. A leg member 106 of the front ski leg 102 is inserted in the front ski support pipe 104. The front ski leg 102 functions to set the ground clearance of a front portion of the litter separating apparatus 10 at a predetermined height, and enhance the slidability of the litter separating apparatus 10 on sand ground. The front ski leg 102 is constructed such that the leg member 106 stands on a front ski plate 108 of a predetermined width having a front portion curved upward toward the front side.

An extension frame 110 extends rearward from the rear side of each of opposite end portions of the rear transverse member 72*b*. A rear ski support pipe 114 for supporting a rear ski leg 112 is provided at a rear end portion of the extension frame 110. The rear ski support pipe 114 is provided in such a way as to penetrate the extension frame 110 in the vertical direction. A leg member 116 of the rear ski leg 112 is inserted in the rear ski support pipe 114. The rear ski leg 112 has a construction and a function similar to those of the front ski leg 102, and is constructed such that the leg member 116 stands on a rear ski plate 118.

The width between the outer ends of the front ski plates 108 of the front ski legs 102 in the left-right direction is substantially the same as the width of the frame 74 in the left-right direction, and the width between the outer ends of the rear ski plates 118 of the rear ski legs 112 in the left-right direction is smaller than the width of the frame 74 in the left-right direction.

Lift arms 120*a*, 120*b* which extend from those outer ends outward in the left-right direction are provided on the left and right outer sides of front and rear portions of the frame 74. Each of the lift arms 120*a*, 120*b* is a member in the shape of a rectangular picture frame long in the transverse direction as viewed in a top view. Each of the lift arms 120*a*, 120*b* is formed to be substantially horizontal at its middle portion in the left-right direction with an inner portion and an outer portion thereof in the left-right direction being bent obliquely downward.

The width between the outer ends of the lift arms 120*a*, 120*b* in the left-right direction is larger than the width of the side structures 50 of the litter collecting station 36 in the left-right direction. Thus, when the litter separating apparatus 10 enters a space between the side structures 50, the lift arms 120*a*, 120*b* get upon the side structures 50, thereby lifting the litter separating apparatus 10 by a predetermined amount.

Figure 6:
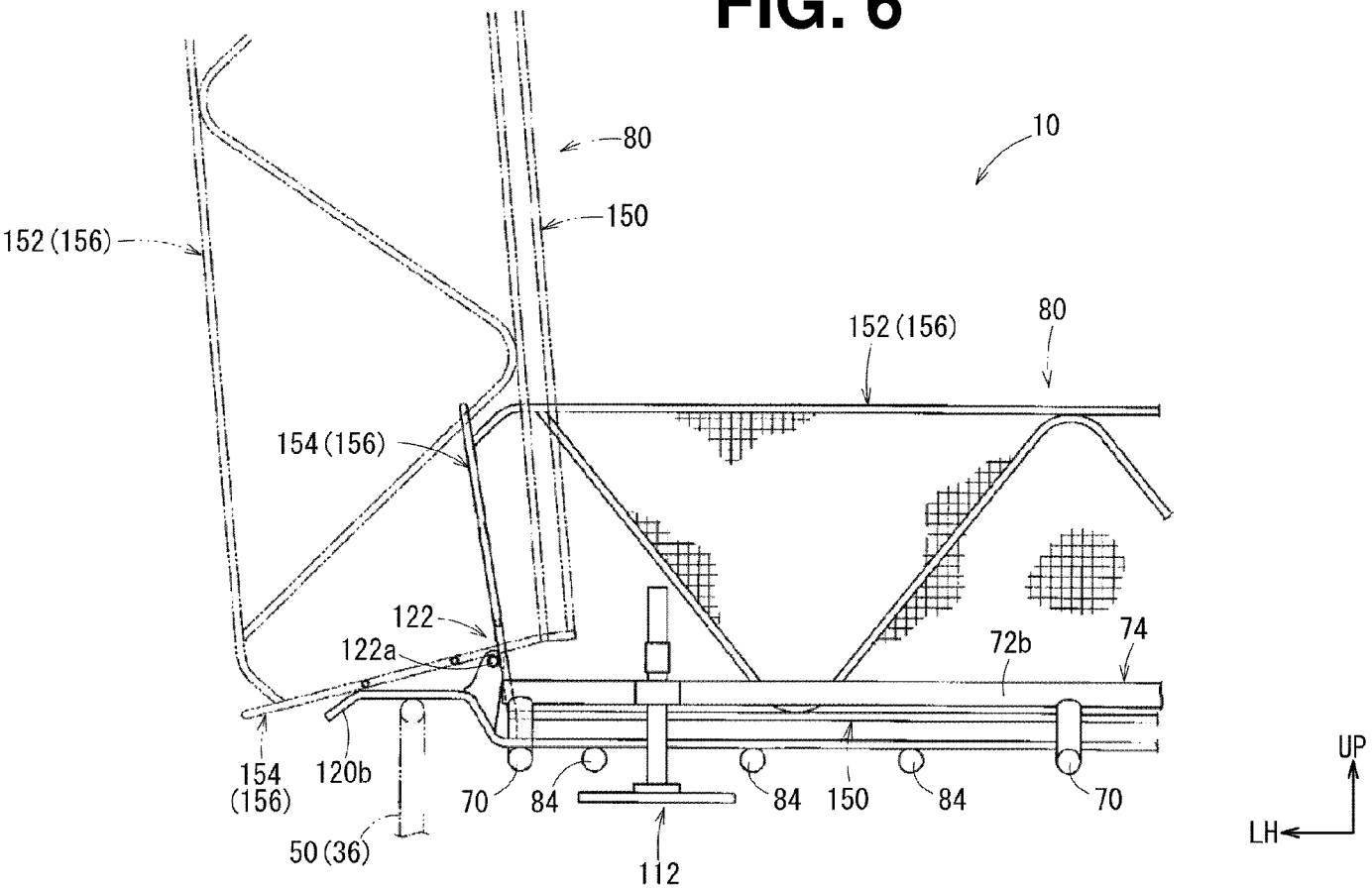
FIG. 6 is a rear view showing a pivoted state of the litter separating apparatus shown in FIG. 1.
Figure 7:
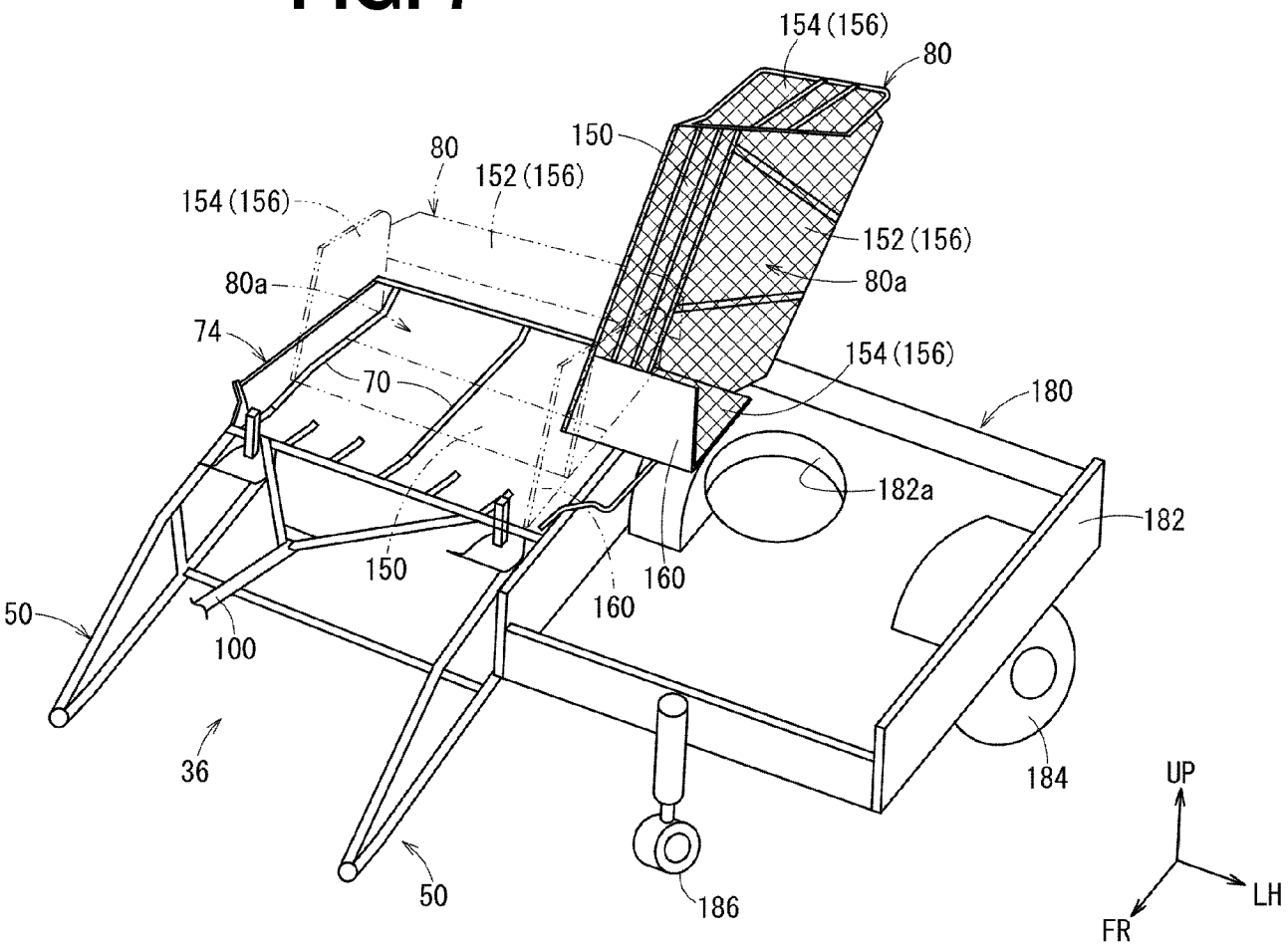
FIG. 7 is a perspective view showing the pivoted state of the litter separating apparatus shown in FIG. 1.

The mesh member 80 is attached to one of the longitudinal members 70 of the frame 74 located on the opposite sides (the leftmost longitudinal member 70 in the embodiment) upwardly pivotally by means of hinges 122. Specifically, a left side wall 154 of the mesh member 80 and the left longitudinal member 70 are connected by the hinges 122. Thus, by moving the right side of the mesh member 80 upward, the mesh member 80 is pivoted (rotated) around a rotation shaft 122*a* of each hinge 122 as shown in FIGS. 6 and 7.

As shown in FIGS. 4, 5, 6, and 7, the mesh member 80 has a box shape having an opening 80*a* open at the front and upper sides and is constructed such that a metallic mesh with a predetermined mesh size is attached to a frame in the shape of a picture frame mainly formed of steel tubes. In the front-rear direction, the mesh member 80 is formed to extend from a position slightly forward of the center of the frame 74 in the front-rear direction to a position near the rear end of the frame 74. In the left-right direction, the mesh member 80 is formed to have a width in the left-right direction substantially the same as that of the frame 74. The position of the front end of the mesh member 80 is spaced toward the rear side from the proximity of the rear ends of the keels 76, i.e., the scrapers 78, by about 100 to 300 mm, so as to well catch sand and litter churned up by the keels 76 and the scrapers 78. More specifically, the position of the front end of the mesh member 80 is spaced toward the rear side from the scrapers 78 by about 250 mm.

The mesh member 80 includes: a bottom wall 150 having a rectangular shape long in the transverse direction in top view; a rear wall 152 standing substantially upright from the rear end of the bottom wall 150; and side walls 154 standing slightly obliquely from the opposite lateral ends of the bottom wall 150 in such a way as to be situated further outside in the left-right direction toward the upper side. The rear wall 152 and the side walls 154 form an encircling portion 156 that encircles the circumference of the bottom wall 150 while leaving the front and upper sides open so that sand and litter churned up by the keels 76 and the scrapers 78 can be deposited on the bottom wall 150. This encircling portion 156 forms the opening 80*a*. The height of the rear wall 152 of the mesh member 80 and the height of each side wall 154 thereof are substantially the same.

The bottom wall 150 has: an inclined portion 150*a* provided in a front section of the bottom wall 150 and slightly inclined downward toward the front side; a front horizontal portion 150*b* provided horizontally behind the inclined portion 150*a*; and a rear horizontal portion 150*c* provided horizontally behind the front horizontal portion 150*b*. The inclined portion 150*a*, the front horizontal portion 150*b*, and the rear horizontal portion 150*c* are partitioned from one another by pipes. Here, for example, a metallic mesh with a mesh size of 25 mm is attached to the inclined portion 150*a*, a metallic mesh of a mesh size of 12 mm is attached to the front horizontal portion 150*b*, and a metallic mesh with a mesh size of 8 mm is attached to the rear horizontal portion 150*c*.

The following is achieved when the mesh sizes of the metallic meshes of the bottom wall 150 are set to become rougher (larger) toward the front side as described above. A part of sand churned up by the keels 76 and scrapers 78 which is moist and relatively heavy does not reach the rear side of the bottom wall 150. As a result, that sand is well sieved through the roughest metallic mesh of the inclined portion 150*a* at the front side of the bottom wall 150, without causing clogging. On the other hand, a part of the sand which is dry and relatively light reaches the front horizontal portion 150*b* or the rear horizontal portion 150*c* of the bottom wall 150 along with litter. As a result, that sand is sieved through the second roughest metallic mesh of the front horizontal portion 150*b* or the finest metallic mesh of the rear horizontal portion 150*c* while the litter does not fall through the metallic mesh but is well caught thereon.

The left side of the mesh member 80 is pivotally connected to the leftmost longitudinal member 70 of the frame 74 by the hinges 122 as described above. When the bottom wall 150 is brought into a substantially upright position by moving the right side of the mesh member 80 upward to pivot the mesh member 80 via the hinges 122, litter deposited in the mesh member 80 falls onto the left side wall 154, and the litter is then moved along the left side wall 154 and discharged out of the mesh member 80.

Figure 8:
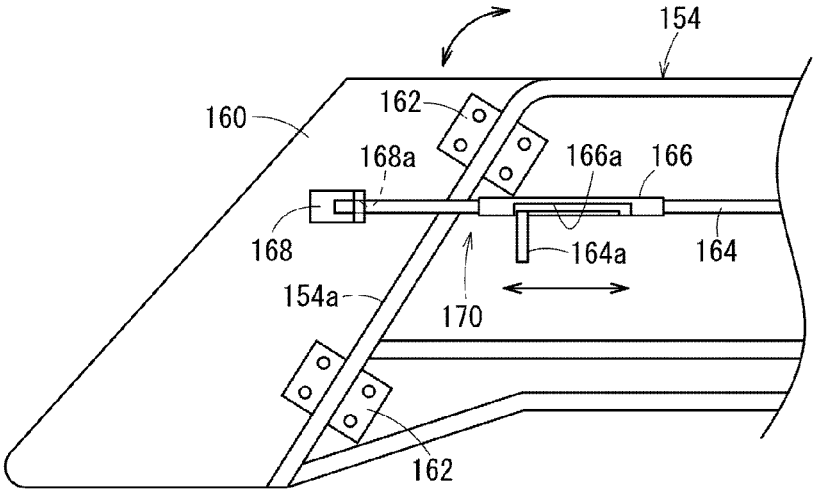
FIG. 8 is a view for describing the attachment construction of an opening-closing plate.

An opening-closing plate 160 is provided to the encircling portion 156. Among the edges of the encircling portion 156 on the open side, the opening-closing plate 160 is pivotable around the edge on the left longitudinal member 70 side, i.e. an open-side edge 154*a* of the left side wall 154. As shown in FIG. 8, with springed hinges 162, the opening-closing plate 160 is provided to the left side wall 154 pivotally around the open-side edge 154*a* of the left side wall 154, and opens and closes at least partially the opening 80*a* open toward the front side. The opening-closing plate 160 is biased to close the opening 80*a* by the springs of the springed hinges 162 and fixed substantially perpendicular to the side wall 154. The opening-closing plate 160 may be brought into contact with the open-side edge of the bottom wall 150 to fix the opening-closing plate 160 substantially perpendicular to the side wall 154. The height of the opening-closing plate 160 is substantially the same as the height of the encircling portion 156.

A support member 166 for slidably supporting a fixing bar 164 is provided on the outer surface of the left side wall 154. The fixing bar 164 includes an operating piece 164*a* for sliding the fixing bar 164 in the front-rear direction. The support member 166 includes a restricting path 166*a* for restricting the movement of the operating piece 164*a*. By moving the operating piece 164*a* along the restricting path 166*a*, the fixing bar 164 can be fixed at any one of a first position at which the tip of the fixing bar 164 protrudes frontward of the edge 154*a* of the side wall 154 (the position shown in FIG. 8) and a second position which is located rearward of the first position. Moreover, a fixing member 168 having a hole 168*a* in which the fixing bar 164 can be inserted is provided on the outer surface of the opening-closing plate 160.

For the opening-closing plate 160 to close the opening 80*a*, the fixing bar 164 is moved from the first position to the second position, so that the fixing bar 164 is pulled out of the hole 168*a* of the fixing member 168, and the springs of the springed hinges 162 close the opening-closing plate 160. Moreover, for the opening-closing plate 160 to open the opening 80*a*, the opening-closing plate 160 is opened against the biasing force of the springed hinges 162, and the fixing bar 164 is moved from the second position to the first position and the fixing bar 164 is inserted into the hole 168*a* of the fixing member 168 to fix the fixing bar 164 at the first position.

The fixing bar 164 and the fixing member 168 form a stopper 170 which stops the biasing force of the springs such that the opening-closing plate 160 faces the same direction as the side wall 154, that is, the plane of the opening-closing plate 160 becomes substantially parallel to the plane of the side wall 154.

A procedure of cleaning a sandy beach using the litter separating apparatus 10 will now be described.

First, the litter collecting station 36 mounted on and carried by the trailer 12 as shown in FIG. 1 is installed at a predetermined position on the sandy beach. Although the litter collecting station 36 is mounted on the trailer 12 in the assembled state in FIG. 1, the litter collecting station 36 may be mounted on the trailer 12 in the state where it is disassembled into the side structures 50 and the connecting members 52. It may be noted that only the foot members 60 are removed from the litter collecting station 36 in FIG. 1.

Then, the level at which the front ski legs 102 and the rear ski legs 112 are attached, and the position on the tow portions 98 to which the tow rods 100 are connected are determined based on the firmness of the sandy beach and the scattering state of litter. Then, the litter separating apparatus 10 is taken down from the trailer 12, and the litter separating apparatus 10 is towered by the towing vehicle 14 to travel on the sandy beach at a constant speed (e.g., 15 to 25 km/h) to thereby pick up relatively small-sized litter on the sandy beach as shown in FIG. 9.

Specifically, as the litter separating apparatus 10 travels on the sandy beach, relatively small-sized litter is churned up by the keels 76 and the scrapers 78 along with sand, and is deposited into the mesh member 80 on the rear portion of the frame 74. During the travel of the litter separating apparatus 10, the stopper 170 stops the biasing force of the springs such that the opening-closing plate 160 faces the same direction as the side wall 154, to obtain a state where the opening 80*a* open toward the front side is left open.

When a predetermined amount of litter is deposited in the mesh member 80 as a result of the traveling of the litter separating apparatus 10 on the sandy beach, the litter separating apparatus 10 is returned to the litter collecting station 36, and collection of the deposited litter is performed. For the collection of the litter, the towing vehicle 14 passes through the space between the side structures 50 of the litter collecting station 36, and thereafter the litter separating apparatus 10 enters the space between the side structures 50. As a result, the lift arms 120*a*, 120*b* provided on the front and rear portions of the litter separating apparatus 10 get upon the side structures 50, thereby lifting the litter separating apparatus 10 by the predetermined amount. In this state, the towing vehicle 14 is stopped, thereby stopping the litter separating apparatus 10.

As shown in FIG. 7, a litter collecting unit 180 is placed to the immediate left of the litter collecting station 36 while the litter separating apparatus 10 is lifted by the litter collecting station 36 by the predetermined amount. The litter collecting unit 180 includes a box part 182 open at the upper side, wheels 184 provided to the box part 182, and a support wheel 186. An opening portion 182*a*, to which a litter collecting bag (not shown) for litter collection, can be attached is provided in the bottom of the box part 182. Meanwhile, during collection of litter, the stopping of the biasing force of the springs by the stopper 170 is released so that the opening-closing plate 160 can be closed.

Subsequently, the bottom wall 150 is brought into the substantially upright position by moving the right side of the mesh member 80 upward to pivot the mesh member 80 via the hinges 122, so that the litter deposited in the mesh member 80 moves into the box part 182 of the litter collecting unit 180 placed to the immediate left thereof. The litter having moved into the box part 182 falls down through the opening portion 182*a* and is thrown into the litter collecting bag provided on the opening portion 182*a*.

During this operation, the opening-closing plate 160 keeps the left side of the opening 80*a* closed, so that the opening-closing plate 160 restricts movement of the litter in the mesh member 80 to the front side even when the litter is collected in the state where the mesh member 80 is pivoted to have the bottom wall 150 stand substantially upright. Accordingly, the litter in the mesh member 80 can be prevented from dropping out of the encircling portion 156 from the front side.

As described above, by providing the encircling portion 156 with the opening-closing plate 160 which is pivotable around the open-side edge 154*a* of the left side wall 154 of the encircling portion 156, the opening-closing plate 160 can open and close at least partially the opening 80*a* open toward the front side. Thus, by closing the opening-closing plate 160 during collection of litter, the litter in the mesh member 80 can be prevented from dropping out of the encircling portion 156 from the front side. This eliminates the need for picking up dropped litter and further improves the efficiency of collection. Accordingly, the man-hour is reduced.

Since the opening-closing plate 160 is attached to the encircling portion 156 by means of the springed hinges 162, the opening-closing plate 160 can be pivotally attached with a simple construction. Moreover, since the opening-closing plate 160 is biased by the springs to close the opening 80*a* and fixed substantially at a right angle to the encircling portion 156 during collection of litter, the litter in the mesh member 80 can be reliably prevented from dropping out of the encircling portion 156 from the front side.

Since the biasing force of the springs is stopped such that the opening-closing plate 160 faces the same direction as the encircling portion 156 during travel, sand and litter can be caught efficiently. Moreover, since the height of the opening-closing plate 160 is substantially the same as the height of the encircling portion 156, the litter in the mesh member 80 can be prevented from dropping out of the encircling portion 156 from the front side during collection of the litter. Further, the opening-closing plate 160 does not protrude upward from the encircling portion 156 when the opening-closing plate 160 is closed, and the exterior is therefore improved.

EXPLANATION OF THE REFERENCE NUMERALS

10 LITTER SEPARATING APPARATUS
12 TRAILER
14 TOWING VEHICLE
20, 38 BODY FRAME
36 COLLECTING STATION

70 LONGITUDINAL MEMBER
72*a*, 72*b* TRANSVERSE MEMBER
74 FRAME
76 KEEL
78 SCRAPER
80 MESH MEMBER
80*a* OPENING
98 TOW PORTION
100 TOW ROD
102 FRONT SKI LEG
112 REAR SKI LEG
150 BOTTOM WALL
152 REAR WALL
154 SIDE WALL
156 ENCIRCLING PORTION
160 OPENING-CLOSING PLATE
162 SPRINGED HINGE
164 FIXING BAR
168 FIXING MEMBER
170 STOPPER
180 COLLECTING UNIT
182 BOX PART
182*a* OPENING PORTION.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A litter separating apparatus, comprising:

a frame including a plurality of longitudinal members, and a plurality of transverse members each extending in a transverse direction perpendicular to the longitudinal members;

a tow portion provided at a front end portion of the frame; a churn-up mechanism arranged at a front portion of the frame;

and a mesh member formed by a plurality of walls including a bottom wall, a rear wall and side walls, arranged at a rear portion of the frame;

wherein:

during operation, when the litter separating apparatus travels on a surface of sand ground by being towed by a towing vehicle, said churn-up mechanism churns up scattered litter along with sand, and throws thus churned up litter into said mesh member which catches the litter;

the mesh member comprises an encircling portion, said encircling portion having an opening formed therein;

said opening being operable to selectively open at least at a side facing a traveling direction of the litter separating apparatus;

the mesh member is mounted on the longitudinal members located on opposite sides; the mesh member is attached upwardly pivotally to one of the longitudinal members located on one of the opposite sides, an opening-closing plate is provided to an open-side edge of one of the side walls of the mesh member, on the longitudinal member to which the mesh member is pivotally attached, the opening-closing plate is pivotable around the open-side edge, and further comprising a springed hinge and a stopper;

wherein the opening-closing plate is pivotally attached to the encircling portion by the springed hinge, and is biased by the springed hinge so as to close the opening of the mesh member, and is fixed substantially at a right angle to one side wall of the mesh member; and wherein during operation, said stopper stops a biasing force of the springed hinge such that the opening-closing plate faces the same direction as one of the side walls, and wherein the opening-closing plate selectively opens and closes the opening at least partially.

2. The litter separating apparatus according to claim 1, wherein a height of the opening-closing plate is substantially the same as a height of the encircling portion.

3. The litter separating apparatus according to claim 1, wherein the churn-up mechanism comprises a plurality of keels and scrappers attached to said longitudinal members.

4. The litter separating apparatus according to claim 1, wherein: the mesh member includes a bottom wall having substantially a rectangular shape when viewed in top view; said rear wall stands substantially upright from a rear end of the bottom wall; said side walls stand slightly obliquely from the opposite lateral ends of the bottom wall; and the height of the rear wall and the height of each of side walls are substantially same.

5. The litter separating apparatus according to claim 1, wherein said mesh member is formed of metallic material.

6. The litter separating apparatus according to claim 1, wherein said mesh comprises a first mesh portion, a second mesh portion arranged behind the first mesh portion, and a third mesh portion arranged behind the second mesh portion; and wherein mesh size of the first mesh portion is greater mesh sizes of the second and third mesh portions.

7. The litter separating apparatus according to claim 6, wherein the first portion has a mesh size of 25 mm, the second portion has a mesh size of 12 mm, and the third portion has a mesh size of 8 mm.

8. The litter separating apparatus according to claim 1, wherein the stopper comprises a fixing bar slidably supported by a support member provided on an outer surface a side wall of the mesh member, and a fixing member, wherein the fixing member is attached to the opening-closing plate and has a hole into which the fixing bar can be inserted, and the fixing bar is moved into the hole to open the opening-closing plate and removed from the hole to close the opening-closing plate.

9. The litter separating apparatus according to claim 1, wherein the churn-up mechanism comprises a plurality of scrapers provided on a front portion of the frame.

10. A litter separating apparatus, comprising a frame assembly;

a churn-up mechanism arranged at a front portion of the frame assembly;

a mesh member formed by a plurality of walls, arranged at a rear portion of the frame assembly;

said mesh member including an encircling portion having an opening formed therein, and pivotally connected to the frame by hinges;

and an opening-closing plate is pivotally mounted on said encircling portion of the mesh member, and further comprising a springed hinge and a stopper;

wherein the opening-closing plate is pivotally attached to the encircling portion by the springed hinge, and is biased by the springed hinge to close the opening of the mesh member, and the opening-closing plate is fixed substantially at a right angle to a portion of the encircling portion;

wherein during operation, said stopper stops a biasing force of the springed hinge such that the opening-closing plate faces the same direction as said portion of the encircling portion; and wherein:

during operation, when the litter separating apparatus towed on a surface of sand ground, said churn-up mechanism churns up scattered litter along with sand, and throws thus churned up litter into said mesh member;

and the opening-closing plate selectively opens and closes the opening so as to empty the collected litter form said mesh member.

11. The litter separating apparatus according to claim 10, wherein a height of the opening-closing plate is substantially the same as a height of the encircling portion.

12. The litter separating apparatus according to claim 10, wherein: said mesh member is formed of metallic material; said encircling portion comprising a rear wall and side walls connected to the rear wall.

13. A litter separating apparatus for cleaning a beach, said litter collecting apparatus comprising:

a frame assembly;

a churn-up mechanism arranged at a front portion of the frame assembly;

a mesh member arranged at a rear portion of the frame assembly;

said mesh member including a bottom wall, a rear wall, and a side walls forming an encircling portion having an opening formed therein; and an opening-closing plate is pivotally mounted on one of said plurality of walls, and is pivotable around an open-side edge of one of the plurality of walls, and further comprising a springed hinge and a stopper;

wherein the opening-closing plate is mounted on one of the plurality of walls of said encircling portion by a springed hinge, and the opening-closing plate is biased by the springed hinge so as to close the opening of the mesh member, and is fixed substantially at a right angle to said one of the walls of the encircling portion; and wherein during a litter collection operation, said stopper stops a biasing force of the springed hinge such that the opening-closing plate faces the same direction as said one of the walls of the encircling portion, to obtain a state where an opening toward the front side is left open; and wherein the opening-closing plate is configured to selectively open and close the opening so as to empty the collected litter from said mesh member.

14. The litter separating apparatus according to claim 13, wherein a height of the opening-closing plate is substantially the same as a height of the encircling portion.

* * * * *